US006816844B2

(12) United States Patent
Leon

(10) Patent No.: US 6,816,844 B2
(45) **Date of Patent: *Nov. 9, 2004**

(54) METHOD AND APPARATUS FOR PERFORMING SECURE PROCESSING OF POSTAL DATA

(75) Inventor: JP Leon, San Carlos, CA (US)

(73) Assignee: Neopost Inc., CA (US)

( * ) Notice: Subject to any disclaimer, the term of this patent is extended or adjusted under 35 U.S.C. 154(b) by 103 days.

This patent is subject to a terminal disclaimer.

(21) Appl. No.: 10/039,538

(22) Filed: Jan. 4, 2002

(65) Prior Publication Data

US 2002/0059145 A1 May 16, 2002

Related U.S. Application Data

(63) Continuation of application No. 09/464,879, filed on Dec. 16, 1999, now Pat. No. 6,381,589, which is a continuation-in-part of application No. 09/250,990, filed on Feb. 16, 1999, now Pat. No. 6,424,954.

(51) Int. Cl.[7] ..... G07B 17/00
(52) U.S. Cl. ..... 705/401; 705/60
(58) Field of Search ..... 705/60, 61, 401, 705/403, 405, 410

(56) References Cited

U.S. PATENT DOCUMENTS

| | | | | |
|---|---|---|---|---|
| 4,447,890 A | * | 5/1984 | Duwel et al. | 705/403 |
| 4,657,697 A | * | 4/1987 | Chiang | 252/301.35 |
| 4,725,718 A | * | 2/1988 | Sansone et al. | 235/495 |
| 4,743,747 A | * | 5/1988 | Fougere et al. | 235/494 |
| 4,757,537 A | * | 7/1988 | Edelmann et al. | 380/51 |

(List continued on next page.)

FOREIGN PATENT DOCUMENTS

| | | | | |
|---|---|---|---|---|
| EP | 0825565 | * | 2/1998 | |
| EP | 0 825 565 | | 2/1998 | ..... G07B/17/00 |
| EP | 0 845 762 | | 4/1998 | ..... G07B/17/00 |
| EP | 0845762 | * | 4/1998 | |
| GB | 1 536 403 | | 12/1978 | ..... C09K/11/00 |
| GB | 1536403 | * | 12/1978 | |
| WO | WO 98/13790 A1 | * | 4/1998 | |
| WO | WO 98/13790 | | 4/1998 | |
| WO | WO 98/14909 | | 4/1998 | |
| WO | WO 98/14909 A2 | * | 4/1998 | |
| WO | WO 98 20461 | | 5/1998 | |
| WO | WO 98/20461 A | * | 5/1998 | |
| WO | WO 00/49580 A1 | * | 8/2000 | |

OTHER PUBLICATIONS

Federal Information Processing Standard (FIPS) PUB 186–2.*

(List continued on next page.)

*Primary Examiner*—Edward R. Cosimano
(74) *Attorney, Agent, or Firm*—Townsend and Townsend and Crew LLP

(57) ABSTRACT

A postal system includes a local computer having a user interface and an associated storage unit for storing a secure data file that contains postal (e.g., accounting) data. A secure processing unit interfaces with the local computer and performs the secure processing normally associated with a secure postal environment. The secure processing unit can be designed to receive power from the computer to which it couples, and generally does not require special interconnect. By using the secure processing unit to perform the secure processing and the local computer to perform other postal functions (e.g., user interface), complexity is reduced which translates to faster speed of operation and a more economical hardware design.

23 Claims, 6 Drawing Sheets

U.S. PATENT DOCUMENTS

| | | | | | |
|---|---|---|---|---|---|
| 4,775,246 | A | * | 10/1988 | Edelmann et al. | 705/62 |
| 4,809,185 | A | * | 2/1989 | Talmadge | 705/403 |
| 4,812,994 | A | * | 3/1989 | Taylor et al. | 705/410 |
| 4,813,912 | A | * | 3/1989 | Chickneas et al. | 705/408 |
| 4,831,555 | A | * | 5/1989 | Sansone et al. | 358/1.14 |
| 4,853,865 | A | * | 8/1989 | Sansone et al. | 705/403 |
| 4,853,961 | A | * | 8/1989 | Pastor | 713/176 |
| 4,949,381 | A | * | 8/1990 | Pastor | 380/51 |
| 5,142,577 | A | * | 8/1992 | Pastor | 705/62 |
| 5,181,245 | A | * | 1/1993 | Jones | 705/61 |
| 5,231,668 | A | | 7/1993 | Kravitz | |
| 5,280,531 | A | * | 1/1994 | Hunter | 382/101 |
| 5,323,323 | A | * | 6/1994 | Gilham | 705/403 |
| 5,377,268 | A | * | 12/1994 | Hunter | 705/63 |
| 5,448,641 | A | * | 9/1995 | Pintsov et al. | 380/51 |
| 5,625,694 | A | * | 4/1997 | Lee et al. | 705/60 |
| 5,638,442 | A | * | 6/1997 | Gargiulo et al. | 380/2 |
| 5,666,421 | A | * | 9/1997 | Pastor et al. | 380/51 |
| 5,688,056 | A | * | 11/1997 | Peyret | 400/61 |
| 5,715,164 | A | * | 2/1998 | Liechti et al. | 705/410 |
| 5,742,683 | A | * | 4/1998 | Lee et al. | 705/60 |
| 5,781,438 | A | * | 7/1998 | Lee et al. | 705/404 |
| 5,793,867 | A | * | 8/1998 | Cordery et al. | 705/60 |
| 5,822,738 | A | * | 10/1998 | Shah et al. | 705/410 |
| 5,920,850 | A | * | 7/1999 | Hunter et al. | 705/405 |
| 5,963,928 | A | * | 10/1999 | Lee | 705/401 |
| 6,081,795 | A | * | 6/2000 | Ryan, Jr. | 705/408 |
| 6,341,274 | B1 | * | 1/2002 | Leon | 705/410 |
| 6,466,921 | B1 | * | 10/2002 | Cordery et al. | 705/60 |
| 6,567,794 | B1 | * | 5/2003 | Cordery et al. | 705/60 |

OTHER PUBLICATIONS

Caton: "Easy access, low cost make collaboration a good outsourced fit—Application services: Risk vs. retrun. (Company Business and Marketing)"; PC Week, Feb. 28, 2000, p. 34.*

Information Based Indicia Program Postal Security Device Specification, United States Postal Service, dated Jun. 13, 1996.*

"Information Based Indicia Program Host System Specification [Draft]," United States Postal Service, dated Oct. 9, 1996.*

"Information–Based Indicia Program (IBIP), Performance Criteria for Information–Based Indicia and Security Architecture for IBI Postage Metering Systems (PCIBISAIBI-PMS)," United States Postal Service, dated Aug. 19, 1998.*

Stallings, William, "Cryptography and Network Security: Principles and Practice, 2.sup.nd Edition," Prentice–Hall, Inc., 1999.*

Barker–Benfield: "First Union Offers Online Transactions"; Florida Times–Union, Jan. 28, 1997.*

FIBS PUB 140–1, Federal Information Processing Standards Publication, (Jan. 11, 1994) Security Requirements for Cryptographic Modules, U.S. Department of Commerce, Ronald H. Brown, Secretary, National Institute of Standards and Technology; pp. 1–51.*

"Information–Based Indicia Program (IBIP), Performance Criteria for Information–Based Indicia and Security Architecture for Closed IBI Postage Metering Systems (PCIBI–C)" Jan. 12, 1999, United States Postal Service, dated Jan. 12, 1999.*

"Information Based Indicia Program (IBIP) Indicium Specification," United States Postal Service, dated Jun. 13, 1996.*

Caton, Michael, Easy Access, Low Cost Make Collaboration a Good Outsourced Fit–Application Services: Risk vs. Return. (Company Business and Marketing) *PC Week* (Feb. 28, 2000) p. 43.

* cited by examiner

METHOD AND APPARATUS FOR PERFORMING SECURE PROCESSING OF POSTAL DATA

This application is a continuation of U.S. patent application Ser. No. 09/464,879, filed on Dec. 16, 1999, now U.S. Pat. No. 6,381,589, which is a continuation-in-part of U.S. patent application Ser. No. 09/250,990, now U.S. Pat. No. 6,424,954, entitled "Postage Meter System," filed Feb. 16, 1999, both of which are incorporate herein by reference.

BACKGROUND OF THE INVENTION

The present invention relates generally to postage metering systems, and more particularly to techniques for performing secure processing of postal data using general purpose or specially designed electronic components and printers.

A postage meter allows a user to print postage or other indicia of value on envelopes or other media. Conventionally, the postage meter can be leased or rented from a commercial group (e.g., Neopost Inc.). The user purchases a fixed amount of value beforehand and the meter is programmed with this amount. Subsequently, the user is allowed to print postage up to the programmed amount.

Since the postage meter is able to imprint indicia having values, security is critical to prevent, deter, and detect frauds. In one conventional security scheme, the postage meter is designed to allow imprint of an indicium only when sufficient funds exist to cover the requested indicium amount. If the postage meter is tampered with, it ceases to function and can only be reactivated by an authorized agent. This scheme guards against fraudulent modification of the meter to print unauthorized postage labels.

A technologically more advanced postage metering system is provided by means of a device known as a Postal Secure Device (PSD). The PSD is a securely packaged electronic circuit protected by an enclosure fabricated in accordance with well-known security principles, such as those described in government standards (e.g., FIPS 140-1) and other security standards. The circuits within the PSD perform accounting and cryptographic functions, and provide a secure "vault" for postal accounting/revenue data. The PSD typically includes the cryptographic hardware and software, a microprocessor, volatile and non-volatile memories, and power conditioning circuits, and is typically supplied with its own DC or AC power from an external connection.

This PSD architecture can be both physically and electronically cumbersome. Numerous circuits are needed, and provided, to support the accounting and cryptographic functions. These circuits render the PSD complicated and costly. Moreover, because complex message interchanges are typically required between the PSD and the host computer to complete each postage printing operation, the speed of data operation is limited, which ultimately limits the cycling speed of the printer.

As can be seen, what is highly desirable are techniques that allow: (1) postal accounting data to remain secure within a real or virtual vault, (2) integration of the vault into a readily available computer such as a personal computer (PC), and (3) rapid operation with reduced need to transfer data into and out of the vault.

SUMMARY OF THE INVENTION

The invention provides a postal system having numerous advantages, including faster speed of operation and economical hardware design. The postal system includes a local computer having a user interface and an associated storage unit for storing a secure data file containing postal (e.g., accounting) data. A secure processing unit interfaces with the local computer and performs the secure processing normally associated with a secure postal environment. The secure processing unit can be designed to receive power from the computer to which it couples, and generally does not require special interconnect. By using the secure processing unit to perform the secure processing and the local computer to perform other postal functions (e.g., user interface, communication with a funding agency), complexity is reduced, which translates to a faster and more economical design.

An embodiment of the invention provides a method for printing a postage indicium. In accordance with the method, which is generally performed at a local computer, a user request to print postage indicium is received and, in response, a data file is retrieved from a storage unit. The data file is secure and includes accounting data (e.g., amount of available finds). The user request and data file are provided to a secure processing unit, which processes the request and generates a print command message. The print command message is processed (e.g., signed, encrypted, or both) to allow for authentication by the receiving unit. The print command message is received from the secure processing unit and, in response, a printer is directed to print the postage indicium. The data file, which has been updated to account for the printed postage indicium, is received from the secure processing unit and stored back to the storage unit.

In an embodiment, the data file includes a descending register indicative of an amount of available funds, an ascending register indicative of an amount of funds previously used, and a control total register indicative of the available plus previously used funds. The data file and print command message can each be encrypted with a particular encryption standard (e.g., DES or RSA), signed with a particular digital signature algorithm (e.g., DSS or elliptical curve), or both. The storage unit can be open and user accessible (e.g., a hard disk drive associated with the local computer). The user request can be for more than one postage indicium, in which case one print command message is generated for each requested postage indicium until all postage indicia have been printed or the process is otherwise terminated (e.g., for lack of funds).

Another embodiment of the invention provides a method for printing a postage indicium. In accordance with the method, which is generally performed at a secure processing unit, a data file and a user request to print postage indicium is received from a host computer. The data file is secure and processed to obtain the accounting data contained therein. A determination is then made as to whether sufficient funds exist to cover the postage indicium. If sufficient fluids exist, the data file is updated to account for the postage indicium, a print command message is generated and sent to the host computer, and the updated data file is secured and transferred back to the host machine. The print command message authorizes printing of the postage indicium, and is processed (e.g., signed, encrypted, or both) to allow for authentication by the receiving unit. The fund determination, update of the data file, and generation and transmission of the print command message can be repeated for each requested postage indicium.

Yet another embodiment of the invention provides a method for funding a postal account. In accordance with the method, which is generally performed at a local computer, a user request to fund the postal account is received and, in response, a data file is retrieved from a storage unit. The data file is secure and includes accounting data. The user request and data file are provided to a secure processing unit for processing. A fund request message is then received from the secure processing unit and forwarded to a funding agency for processing. Next, an authorization message is received from the funding agency and forwarded to the secure processing unit. The data file is updated with additional funds in accordance with the authorization message. The updated data file is then received from the secure processing unit and stored back to the storage unit. The fund request and authorization messages are processed to allow for authentication by the receiving unit.

Yet another embodiment of the invention provides a method for funding a postal account. In accordance with the method, which is generally performed at a secure processing unit, a secure data file and a user request to fund the postal account are received from a host computer. The data file is processed to obtain accounting data stored therein, and a fund request message is generated based on the user request. The fund request message is sent to the host computer for processing and, in response, an authorization message is received and authenticated. If the authorization message is determined to be authentic, the data file is updated to include additional funds authorized by the authorization message. The updated data file is then secured and transferred back to the host machine. The fund request and authorization messages are processed to allow for authentication by the receiving units.

Yet another embodiment of the invention provides a postage metering system that includes a local computer that interfaces with a secure processing unit. The local computer includes a user interface that receives a user request and a storage unit that stores a data file. The data file is secure and includes accounting data. The secure processing unit includes a memory coupled to a processing unit. The memory stores the data file. The processing unit receives the data file and the user request, processes the user request, generates a first message responsive to the user request, updates the data file to account for the processed user request, secures the updated data file, and sends the secure data file back to the local computer. The first message is processed to allow for authentication by the receiving unit. The user request can be for a printing of postage indicium or a funding of a postal account.

Yet another embodiment of the invention provides a secure processing unit for use in a postage metering system. The secure processing unit includes a memory coupled to a processing unit. The memory stores a secure data file that includes accounting data. The processing unit receives the data file and a user request for a particular postal transaction, processes the user request, generates a first message responsive to the user request, updates the data file to account for the processed user request, and secures the updated data file. The first message is processed to allow for authentication by the receiving unit.

The invention further provides program product that implements or facilitates the various embodiments described above.

The foregoing, together with other aspects of this invention, will become more apparent when referring to the following specification, claims, and accompanying drawings.

DESCRIPTION OF THE SPECIFIC EMBODIMENTS

Figure 1:
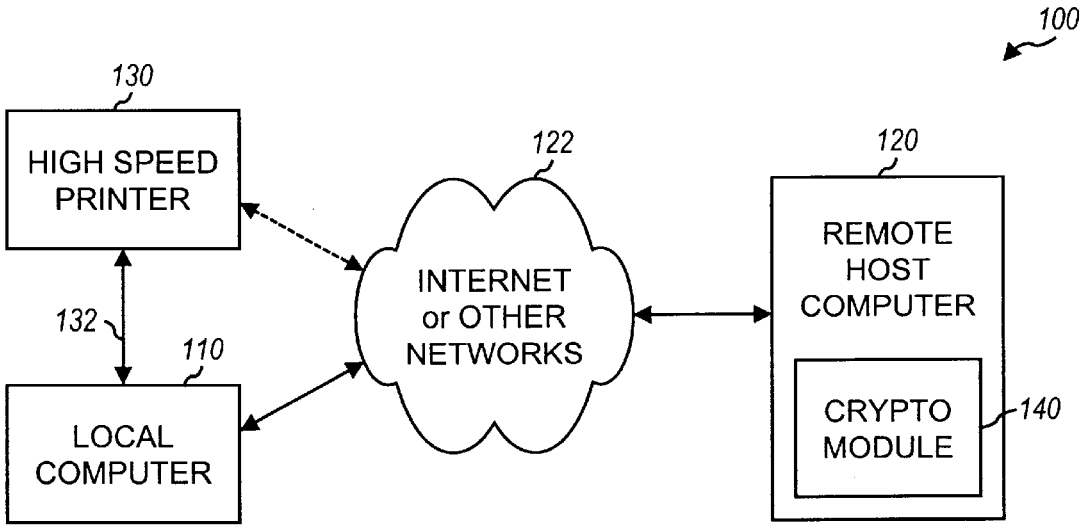
FIGS. 1 and 2 show diagrams of two embodiments of a postal system in accordance with the invention.

FIG. 1 shows a diagram of an embodiment of a postal system 100 in accordance with the invention. Postal system 100 includes one or more local computers 110 coupled to a remote host computer 120 via a communications link 122 (only one local computer is shown in FIG. 1 for simplicity). Local computer 110 further couples to a high-speed printer 130 via network 122 or a direct (e.g., dedicated) communications link 132. Local computer 110 interfaces with the user and typically includes storage facilities (e.g., disk drive, non-volatile memories, and so on) for storing postal data. Alternatively or additionally, the postal data can be stored in storage facilities located at remote host computer 120.

Remote host computer 120 includes a secure processing unit 140 (also referred to as a cryptographic module) that provides secure processing of postal data. Secure processing unit 140 is physically protected against tampering, for example, by a FIPS-140-1 Level 4 enclosure, or by other means. The combination of remote host computer 120 and secure processing unit 140 acts as a "virtual vault." Remote host computer 120 may optionally include an internal or external modem (not shown in FIG. 1) to provide secure and/or non-secure data transmission to a funding center such as a postal authority (e.g., the United States Postal Service), a meter manufacturer (e.g., Neopost Inc.), a financial institution (e.g., a bank), a commercial postal system (e.g., Postage-on-Call or POC), or a combination thereof. The operations of, and the interactions between, local computer 110, remote host computer 120, high-speed printer 130, and secure processing unit 140 are described in further details below.

Communications links 122 and 132 can each be a dedicated link such as a telephone, cable, cellular, terrestrial, satellite, RF, infrared, microwave, or other types of link. Communications links 122 and 132 can each also be a network such as the Internet, a local area network (LAN), a wide area network (WAN), or other types of network.

Various communications protocols can be used for data transmission. For example, the communication between local computer 110 and high-speed printer 130 can conform to a data I/O protocol such as RS-232C, TCP/IP, serial, parallel, universal serial bus (USB), or other protocols.

The postal system architecture shown in FIG. 1 provides various advantages. The local computer provides many of the meter functions, including the user interface. The remote host computer and the enclosed secure processing unit provide the secure processing necessary to maintain a secure environment to deter against fraud. A single secure processing unit can be used to service multiple local computers.

Figure 2:
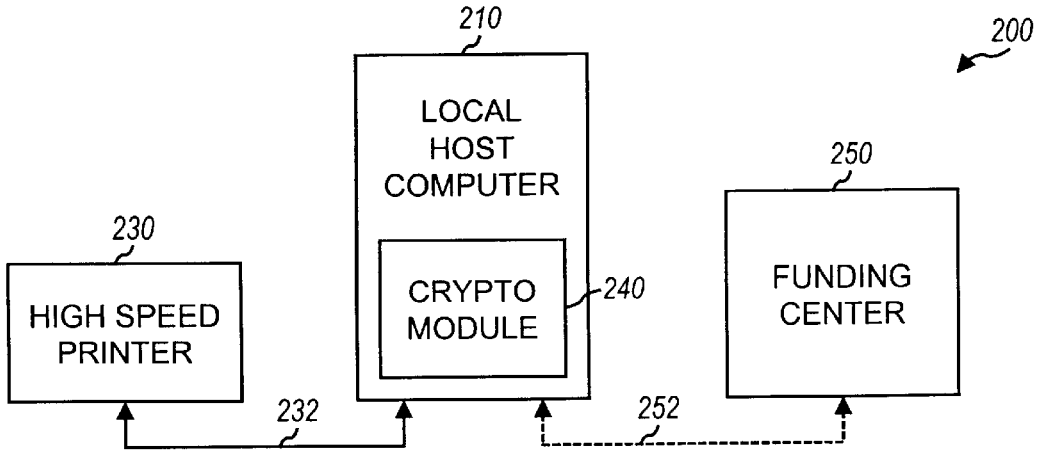

FIG. 2 shows a diagram of an embodiment of a postal system 200 in accordance with the invention. A local host computer 210 couples to a high-speed printer 230 via a communications link 232. Local host computer 210 optionally includes an internal or external modem to provide secure and/or non-secure data transmission via a communications link 252 to a funding center 250 for recrediting. Communications links 232 and 252 can each be a dedicated link or a network, and can facilitate data transmission using various data protocols, as described above. Local host computer 210 includes a secure processing unit 240 that provides secure processing of postal data. Secure processing unit 240 is physically protected against tampering, as described above.

Various modifications can be made to the postal systems shown in FIGS. 1 and 2. For example, in FIG. 1, local computer 110 can be operated as a thin client, a terminal, a web browser, a stand-alone PC, or others. Local computer 110 can also couple to remote host computer 120 via a direct and dedicated line, an Internet service provider (ISP), or through some other mechanisms.

For simplification, the machine through which the user or operator interacts is referred to as a "local computer," and the machine to which the secure processing unit couples is referred to as a "host computer." For the embodiments shown in FIGS. 1 and 2, local computer 110 and local host computer 210 are the local computers through which the user interacts to request postal operations, and remote host computer 120 and local host computer 210 are the host computers to which the secure processing unit couples. A machine can operate as both the local and host computer, as is the case for local host computer 210.

In a specific embodiment, the local computer incorporates a high-speed printer within the same enclosure. In this embodiment, the local computer and printer are packaged within a common enclosure, and a common power supply and user interface can serve both units.

Figure 3:
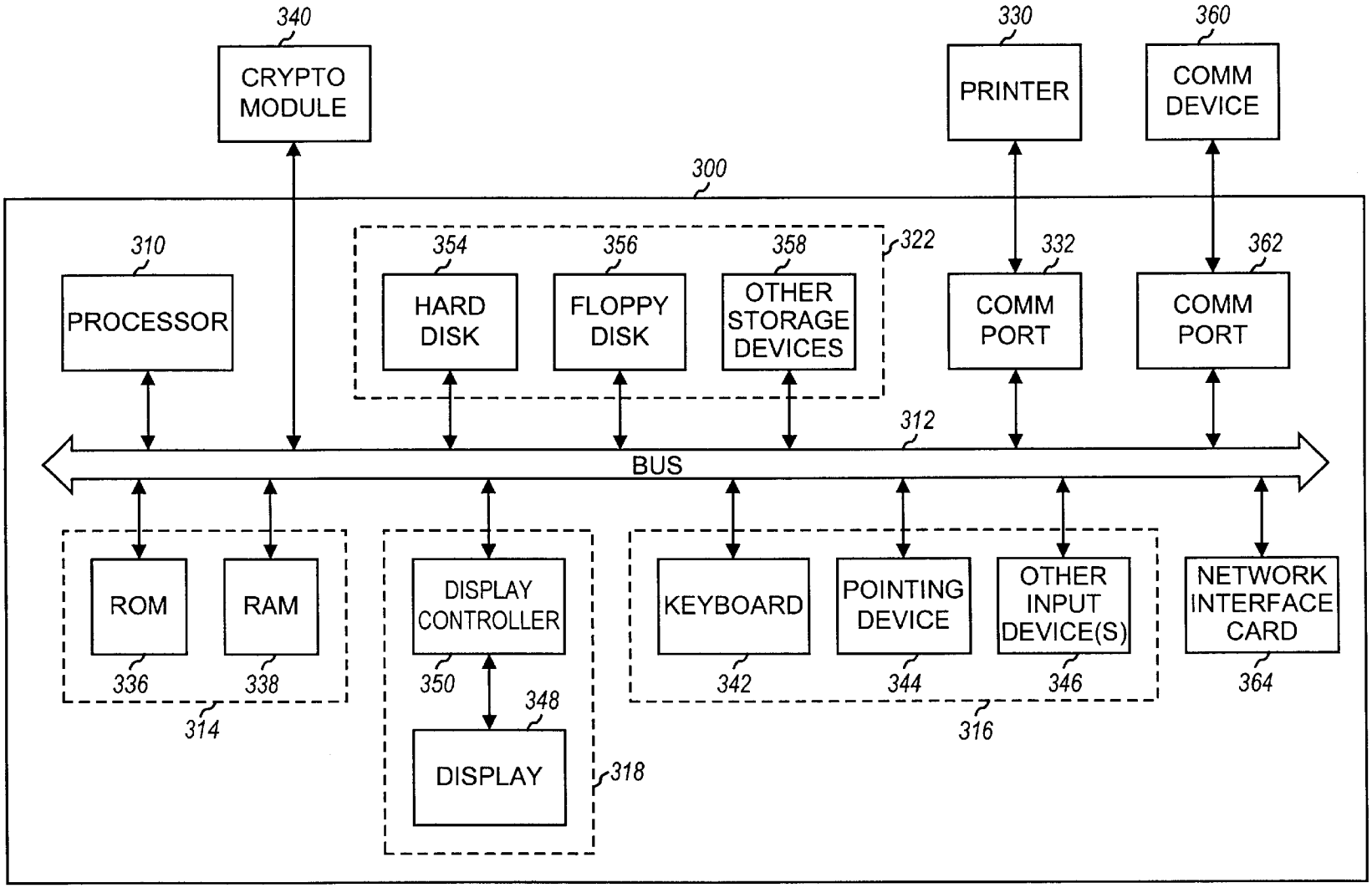
FIG. 3 shows a block diagram of an embodiment of a computer that can be used to implement a local or host computer.

FIG. 3 shows a block diagram of an embodiment of a computer 300 that can be used to implement the local and host computers shown in FIGS. 1 and 2. Computer 300 may be a general-purpose computer system, a portable system, a simplified computer system designed for the specific application described herein, a server, a workstation, a mini-computer, a larger mainframe system, or other computing systems.

As shown in FIG. 3, computer 300 includes a processor 310 that communicates with a number of peripheral devices via a bus 312. These peripheral devices typically include a memory subsystem 314, a user input subsystem 316, a display subsystem 318, a file storage system 322, and I/O output devices such as a printer 330 and a communication (comm) device 360. Memory subsystem 314 may include a number of memory units, including a non-volatile memory 336 (designated as a ROM) and a volatile memory 338 (designated as a RAM) in which instructions and data may be stored. User input subsystem 316 typically includes a keyboard 342 and may further include a pointing device 344 (e.g., a mouse, trackball, or the like), other common input device(s) 346 (e.g., touch screen, push buttons, and others), or a combination thereof. Display subsystem 318 typically includes a display device 348 (e.g., a cathode ray tube (CRT), a liquid crystal display (LCD), or other devices) coupled to a display controller 350. File storage system 322 may include a hard disk 354, a floppy disk 356, other storage devices 358 (such as a CD-ROM drive, a tape drive, or others), or a combination thereof.

Computer 300 includes a number of I/O devices that facilitate communication with external units. For example, a communications (COMM) port 332 interfaces with printer 330. Communications with external systems can be established via communications device 360 (e.g., a modem, a switch, or other devices) that couples to a communication port 362. Computer 300 can interact with a network via communication device 360 or a network interface card 364.

For remote host computer 120 in FIG. 1 and local host computer 210 in FIG. 2, a secure processing unit 340 couples directly to computer 300 via bus 312 (as shown in FIG. 3) or indirectly via a communication port. Although not shown in FIG. 3, secure processing unit 340 is typically enclosed within the housing of computer 300 to deter tampering.

Each computer in FIGS. 1 and 2 can be implemented with a subset of the elements shown for computer 300, and can also include additional elements not shown in FIG. 3. For example, communications ports 332 and 362 may not be required if printer 330 and communications device 360 can be coupled directly to bus 312. Further, user input subsystem 316, display subsystem 318, and file storage system 322 can be simplified or may not be required. For example, remote host computer 120 in FIG. 1 can be implemented with a greatly simplified version of computer 300.

As used herein, the term "bus" generically refers to any mechanism for allowing various elements of the system to communicate with each other. Bus 312 is shown as a single bus but may include a number of buses. For example, a system typically has a number of buses including a local bus and one or more expansion buses (e.g., ADB, SCSI, ISA, EISA, MCA, NuBus, or PCI), as well as serial and parallel ports.

With the exception of the input devices and the display, the other elements need not be located at the same physical site. For example, portions of the file storage system can be coupled via various local-area or wide-area network links, including telephone lines. Similarly, the input devices and display need not be located at the same site as the processor, although it is anticipated that the present invention will likely be implemented in the context of general-purpose computers and workstations.

Figure 4:
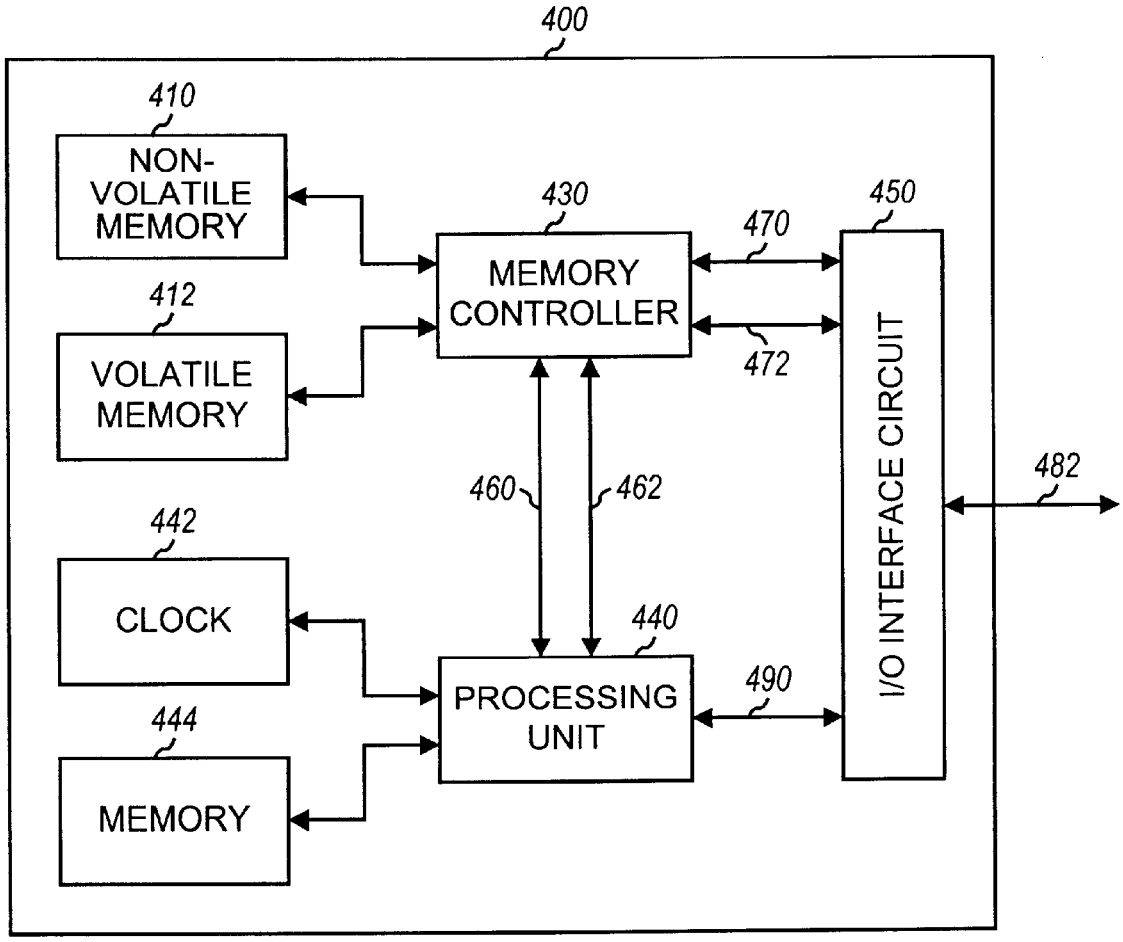
FIG. 4 shows a simplified block diagram of an embodiment of a secure processing unit.

FIG. 4 shows a simplified block diagram of an embodiment of a secure processing unit 400 that can implement the secure processing units shown in FIGS. 1 and 2. Within secure processing unit 400, a non-volatile memory 410 and a volatile memory 412 receive data from, and provide data to, a memory controller 430. Memories 410 and 412 provide storage of postal accounting data, program codes, and other data.

Memory controller 430 may be accessed by a processing unit 440 and an input/output (I/O) interface circuit 450. Control unit 440 accesses memories 410 and 412 by reading or writing on data lines 460, and controls these operations via control lines 462. I/O interface circuit 450 accesses memories 410 and 412 by reading or writing data on data lines 470, and controls these operations via control lines 472. I/O interface circuit 450 communicates with the host computer via an I/O port 482.

Processing unit 440 performs cryptographic functions and other functions, and communicates with I/O port 482 via control and data lines 490 and I/O interface circuit 450. Processing unit 440 may couple to a clock 442, a memory 444, and other circuitry (not shown in FIG. 4) that supports the operation of processing unit 440. Memory 444 may comprise volatile and/or non-volatile memories.

Processor 310 and processing unit 440 can each be implemented as an application specific integrated circuit (ASIC), a digital signal processor, a controller, a microcontroller, a microprocessor, or other electronic units designed to perform the functions described herein. Non-volatile memories 336 and 410 can each be implemented as a read only memory (ROM), a FLASH memory, a programmable ROM (PROM), an erasable PROM (EPROM), an electronically erasable PROM (EEPROM), a battery augmented memory (BAM), a battery backed-up RAM (BBRAM), or devices of other memory technologies. Volatile memories 338 and 412 can each be implemented as a random access memory (RAM), a dynamic RAM (DRAM), a FLASH memory, or devices of other memory technologies.

Software codes to execute various aspects of the invention are located throughout the postal system (e.g., within the secure processing unit, the local computer, and the host computer). For example, in FIG. 1, software codes resident on local computer 110 enable communication with remote host computer 120. Similarly, software codes resident on remote host computer 120 enable communication with local computer 110 and secure processing unit 140. Software codes resident on secure processing unit 140 enable communication with remote host computer 120. An example of a protocol that supports communication between the host computer and the secure processing unit is disclosed in the aforementioned U.S. patent application Ser. No. 09/250,990, now U.S. Pat. No. 6,424,954. Software codes for performing the encryption functions of secure processing unit 140 can be implemented similar to that disclosed in the aforementioned U.S. patent application Ser. No. 09/250,990, now U.S. Pat. No. 6,424,954.

The secure processing unit performs some of the secure processing required by the postal system. This secure processing may comprise encryption, encoding, digital signature generation, and other functions. These functions may be performed by a sub-unit of processing unit 440, such as a hardware security processor (not shown). Alternatively, the functions may be performed by a software algorithm resident in memory 444 and executed by processing unit 440. The secure processing may implement, for example, the DES (data encryption standard) and RSA (Rivest, Shamir, and Adleman) algorithms for encryption, the DSA (digital signature algorithm) and elliptical curve algorithms for digital signature generation, and other algorithms. Encryption/decryption and digital signature generation/authentication are further described in detail in a book by William Stallings, entitled "Cryptography and Network Security: Principles and Practice, 2$^{nd}$ Edition," Prentice-Hall, Inc., 1999, which is incorporated herein by reference. A specific DSA is embodied in the digital signature standard (DSS) defined by the National Institute of Standards and Technology (NIST) and published in Federal Information Processing Standard FIPS PUB 186, which is incorporated herein by reference.

The postal data includes accounting data and other data used to process the requested postal operation. In an embodiment, the accounting data includes an ascending register (AR), a descending register (DR), and a control total register (CT). The ascending register holds a value indicative of the amount of postage previously used, the descending register holds a value indicative of the amount of postage that remains unused (i.e., the available funds), and the control total register holds the sum of the values in the ascending and descending registers. In an embodiment, the accounting data is embodied in a secured form (e.g., encrypted) prior to storage. The postal data may further include, for example, an identifying serial number or a post office license number that uniquely identifies a particular user. The postal data is stored in a non-volatile storage unit (e.g., a hard disk drive) associated with the local computer or the host computer, or both.

When a secure postal operation is requested by the user, the secure postal data is retrieved from the storage unit and provided to the secure processing unit. The secure operation can be a postage printing operation, a funding operation, or other operations that modify the accounting registers. The secure processing unit processes the requested operation, updates the postal data, and sends the updated data and a secure message to the host computer. The secure processing unit provides the cryptographic functions used to achieved a secure environment, and can be implemented with less circuitry than a PSD. The local computer provides the support postal functions, such as the user interface, the data processing, and the interface to the printer that actually prints the postage indicia.

Figure 5:
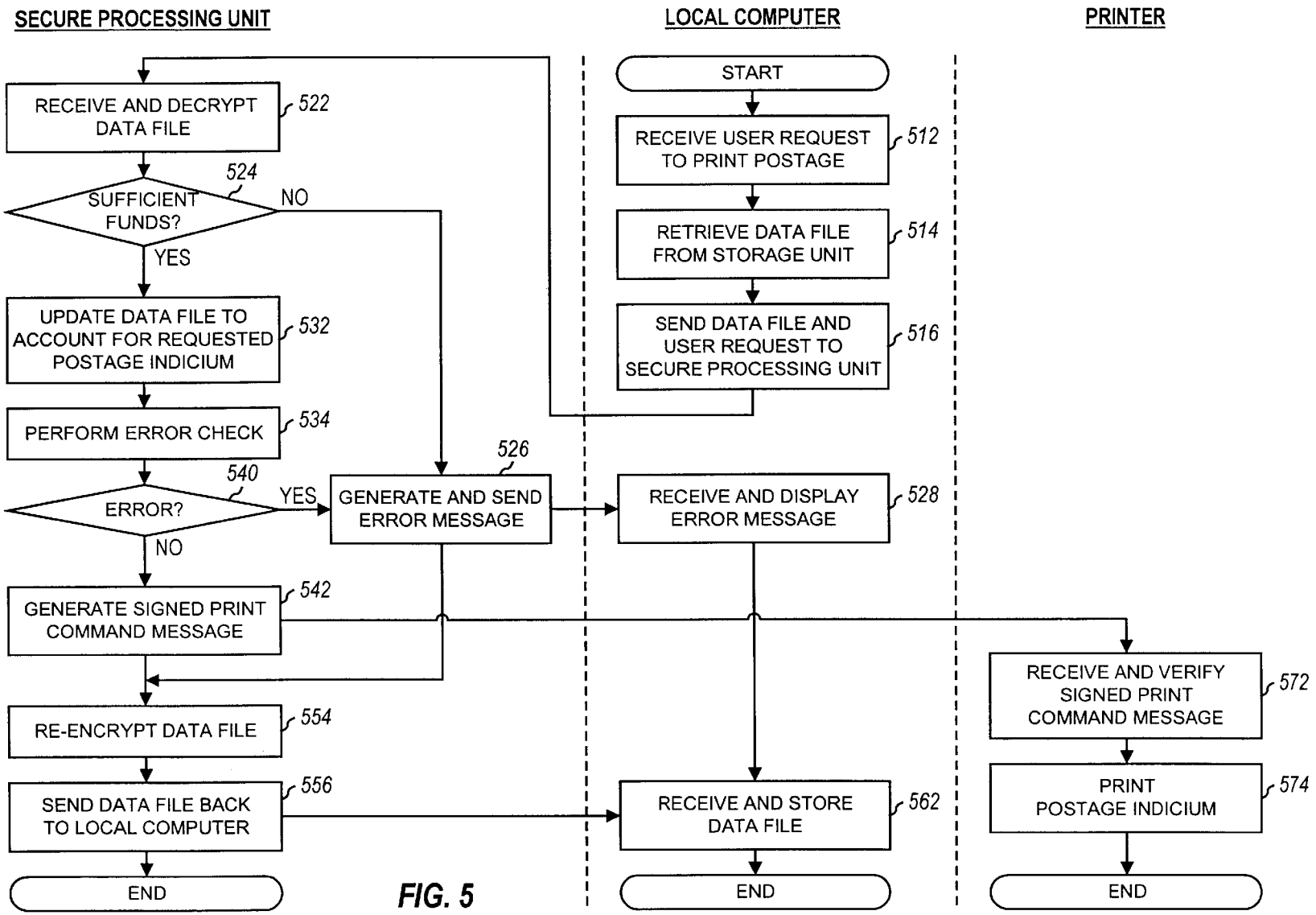
FIGS. 5 and 6 show flow diagrams of two specific embodiments of a postage printing process.

FIG. 5 shows a flow diagram of a specific embodiment of a postage printing process for the postal systems shown in FIGS. 1 and 2. At block 512, a user or operator interacts with the local computer (e.g., local computer 110 in FIG. 1 or local host computer 210 in FIG. 2) and initiates a postage print cycle. In response to the user request, a secure data file is retrieved from a storage unit (e.g., the hard disk or memory associated with the local computer), at block 514, and sent along with the user request to the secure processing unit, at block 516. The data file includes postal data needed to execute the requested postal operation, such as accounting data (e.g., the ascending, descending, and control total registers) and other data (e.g., a unique identifying serial or license number, a credit card number or other identifier that authorizes payment by the agency). The data file can be made secure by a number of processes such as encryption, encoding, digital signature, other processes, or a combination thereof.

The secure processing unit receives the data file and decrypts the file within its secure boundary, at block 522. The secure processing unit then determines whether sufficient funds exist in the descending register to cover the requested postage imprint, at block 524. This determination can be achieved by comparing the amount of the print request to the value stored in the descending register. If the available funds are insufficient (e.g., the requested amount is greater than the value in the descending register), the secure processing unit generates and sends an appropriate error message (e.g., "Error—insufficient funds"), at block 526, and proceeds to block 554. The local computer receives and displays the error message, at block 528, and proceeds to block 562. Otherwise, if sufficient funds exist to cover the requested indicium, the secure processing unit performs arithmetic operations within its secure boundary and updates the accounting registers to account for the requested postage indicium, at block 532. The amount to be printed is deducted from the descending register and added to the ascending register.

An error check routine is then performed to verify that the calculations to update the descending and ascending registers are completed correctly, at block 534. In an embodiment, the error check routine consists of adding the ascending register to the descending register to produce a new control total register, and comparing the newly computed control total register to the previously stored control total register. Alternatively, other error check routines may be performed.

At block 540, a determination is made whether an error was discovered by the error check routine. For the example above, an error is indicated if the newly computed and previously stored values for the control total register are not the same. If no errors are discovered, the process proceeds to block 542. Otherwise, in response to a discovered error, an appropriate error message (e.g., "Error encountered during processing") is generated at block 526 and sent to the local computer, which displays the error message. From block 526, the secure processing unit proceeds to block 554.

After successfully completing the error check routine, a secure (e.g., signed) print command message is generated by the secure processing unit, at block 542, and transmitted to the printer via the local computer. This print command message may be encrypted or unencrypted, depending on the requirement of the particular system architecture. For example, encryption can be used if undetected interception is possible, and can be omitted if such interception is impossible or unlikely, such as when the printer and local computer are housed in the same enclosure. The printer receives and verifies the signed print command message, at block 572, and prints the requested postage indicium, at block 574.

From block 542, the secure processing unit proceeds to block 554 where it re-encrypts the data file within its secure boundary. The encrypted data file is then sent outside the secure boundary back to the local computer, at block 556, which receives and stores the data file in the storage unit, at block 562. This completes one print cycle, which produces a single imprint of a postage indicium. In an embodiment, the user does not have access to the data files, which reside on a server in a secure location.

Figure 6:
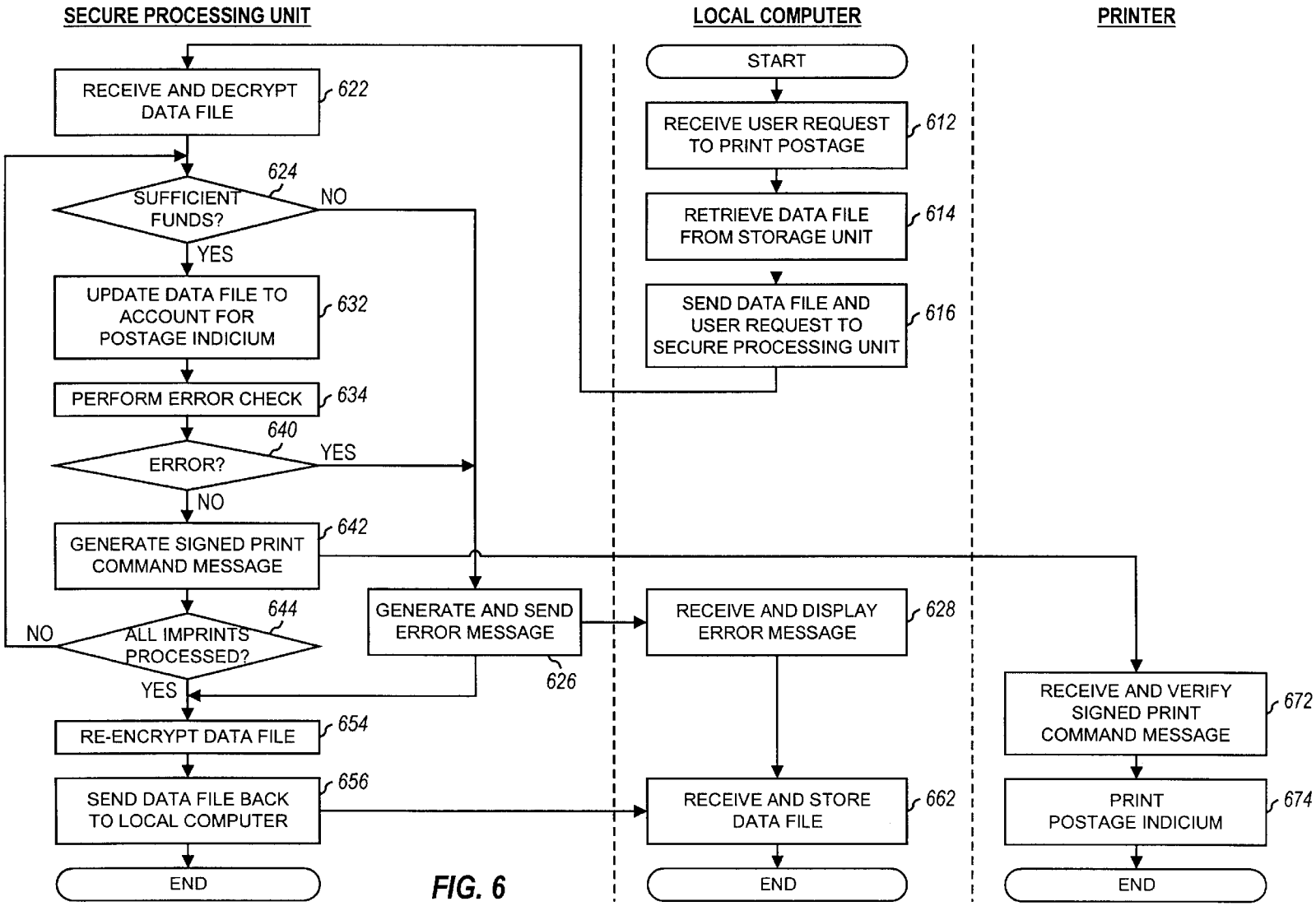

FIG. 6 shows a flow diagram of another specific embodiment of a postage printing process. At block 612, a user interacts with the local computer and requests multiple imprints with a single user command. The requested imprints can be of the same value or of different values. In response to the user request, a secure data file is retrieved from a storage unit, at block 614, and sent along with the user request to the secure processing unit, at block 616.

The secure processing unit receives the data file and decrypts the file within its secure boundary, at block 622. The secure processing unit then determines whether sufficient funds exist in the descending register to cover the first requested postage imprint, at block 624. This determination can be achieved in the manner described above. If the available funds are insufficient, the secure processing unit generates and sends an appropriate error message (e.g., "Error—insufficient funds"), at block 626, and proceeds to block 654. The local computer receives and displays the error message, at block 628, and proceeds to block 662. Otherwise, if sufficient funds exist in the descending register, the secure processing unit performs arithmetic operations within its secure boundary and updates the accounting registers to account for the requested postage indicium, at block 632. The amount to be printed is deducted from the descending register and added to the ascending register.

An error check routine is then performed (e.g., in the manner described above) to verify that the calculations to update the descending and ascending registers are completed correctly, at block 634. At block 640, a determination is made whether an error was discovered by the error check routine. If no errors are discovered, the process proceeds to block 642. Otherwise, in response to a discovered error, an appropriate error message (e.g., "Error encountered during processing") is generated at block 626 and sent to the local computer, which displays the error message. From block 626, the secure processing unit proceeds to block 654.

After successfully completing the error check routine, a secure (e.g., signed) print command message is generated by the secure processing unit, at block 642, and transmitted to the printer via the local computer. This print command message may be encrypted or unencrypted, depending on the requirement of the particular system architecture. The printer receives and verifies the signed print command message, at block 672, and prints the postage indicium, at block 674.

Since multiple imprints are requested, the decrypted data file is retained within the secure processing unit after the print command message is generated. At block 644, a determination is made whether all requested imprints have been processed. If the answer is no, the process returns to block 624 where a determination is made whether sufficient funds exist in the descending register to cover the next requested imprint. Alternatively, if all requested imprints have been processed, the process continues to block 654. The loop comprising blocks 624 through 644 are repeated until all requested imprints have been processed or the process is otherwise terminated (e.g., there are insufficient funds in the descending register to cover the requested imprint).

At block 654, the secure processing unit re-encrypts the data file within its secure boundary. The encrypted data file is sent outside the secure boundary back to the local computer, at block 556, which receives and stores the file in the storage unit, at block 662. This completes one print command, which produces multiple imprints of postage indicia.

Figure 7:
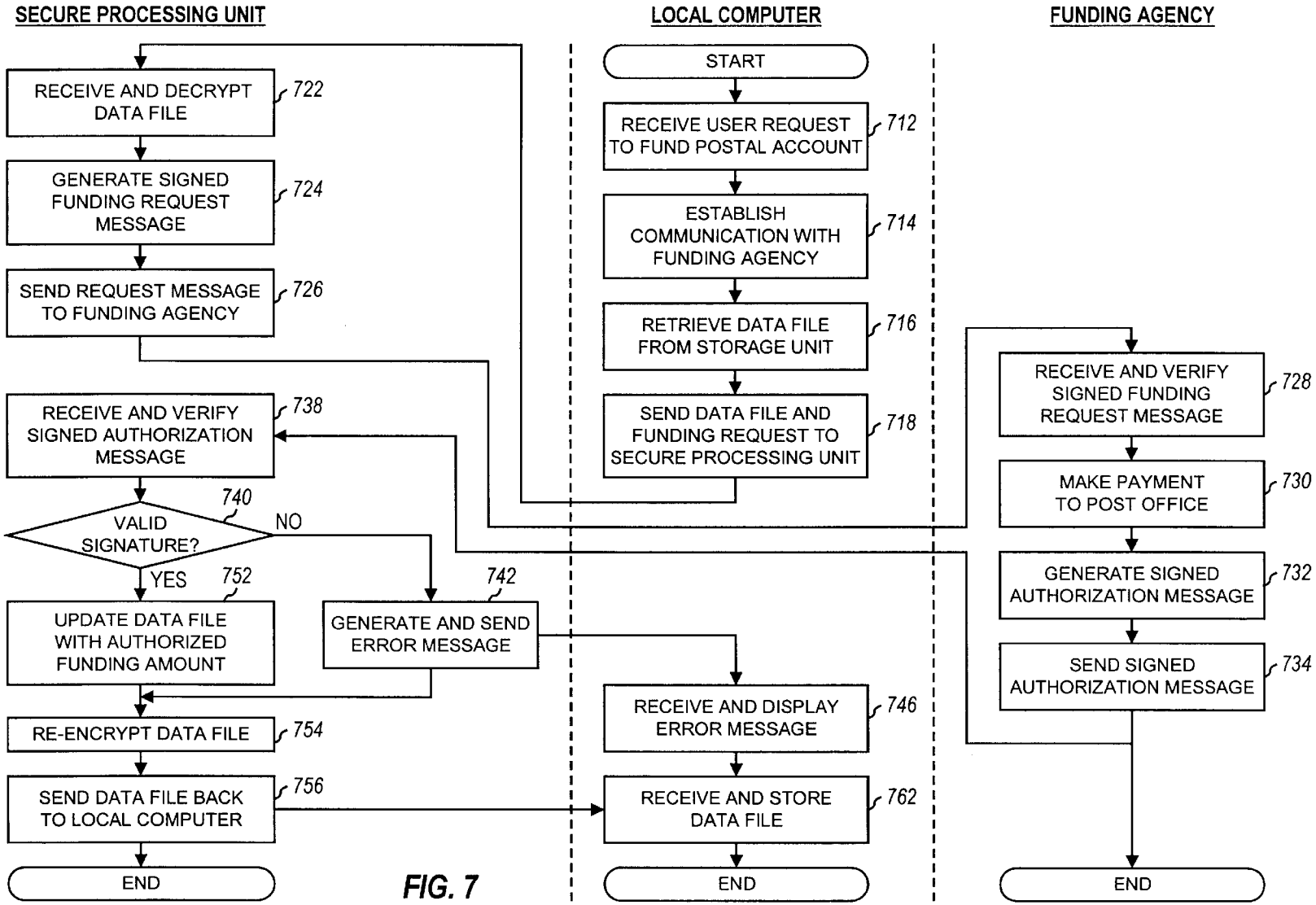
FIG. 7 shows a flow diagram of a specific embodiment of a process for increasing the funds in a postal data file.

FIG. 7 shows a flow diagram of a specific embodiment of a process for increasing the funds in a postal data file. At block 712, a user interacts with the local computer and enters a request to fund a postal account (i.e., add credit to the descending register). In response to the funding request, the local computer establishes communication with a funding agency, at block 714. The funding agency (or simply "the agency") can be a meter manufacturer, a financial institution, or any other agency that offers the service. A secure data file is then retrieved from the storage unit, at block 716, and sent along with the funding request to the secure processing unit, at block 718.

The secure processing unit receives the data file and decrypts the file within its secure boundary, at block 722. The secure processing unit then generates a secure (e.g., signed) funding request message, at block 724. In an embodiment, the funding request message includes a unique identifying serial or license number, a request to purchase postal credit, the amount desired, and a credit card number or other identifier that authorizes payment by the agency. The authorization for payment may be for transfer of the user's previously deposited funds, or may be an agreement by the user to create a debt owed to the agency or to another party (e.g., a bank). The signed funding request message, which may be encrypted or unencrypted, is transmitted to the agency, at block 726.

The agency receives and verifies the signed funding request message, at block 728. If the request is acceptable to the agency (e.g., the signature is authenticated), the agency then makes payment to the post office, at block 730. Payment can be made, for example, by means of a standard type of electronic funds transfer (EFT) or by other methods. The agency then generates a secure (e.g., signed) authorization message, at block 732, which authorizes and enables the update of the data file. The authorization message may or may not be encrypted, and is sent to the secure processing unit via the local computer, at block 734.

The secure processing unit receives and verifies the signature on the authorization message, at block 738. The secure processing unit then determines, at block 740, whether the signature is valid. If the signature is invalid, the secure processing unit generates and sends an appropriate error message (e.g., "Error—requested transaction not authorized") to the local computer, at block 742, which receives and displays the error message, at block 746. From block 742, the secure processing unit proceeds to block 754. Otherwise, if the signature is determined to be valid, the secure processing unit updates the data file within its secure boundary to account for the authorized funding amount, at block 752. After updating, the data file is re-encrypted, at block 754, and transferred back to the local computer, at block 756. The local computer receives and stores the updated data file, at block 762. The funding operation then terminates.

Many variations of the specific embodiments shown in FIGS. 5 through 7 can be envisioned by one of skill in the art and are within the scope of the invention. For example, in FIGS. 5 and 6, the error checking can be omitted or can entail a more complex checking process. And in FIG. 7, the authorization message (or an equivalent message) can be provided by the local computer. For example, the user can provide to the local computer a debit card having funds stored therein. The local computer transfers a secure file from the debit card to the secure processing unit. The secure processing unit decrypts and deducts the debit card file by the requested funding amount and sends back an updated debit card file to the local computer for storage back to the debit card.

In an embodiment, the entire data file is secure and the secure processing unit decrypts and re-encrypts to postal data contained in the data file. In some embodiments, only a portion of the data file is secure. For example, only the accounting data such the descending, ascending, and control total registers may be made secure.

The printing and funding processes may be conducted, for example, via the Internet, a dedicated telephone line, or other communications links.

The foregoing description of the specific embodiments is provided to enable any person skilled in the art to make or use the present invention. Various modifications to these embodiments will be readily apparent to those skilled in the art, and the generic principles defined herein may be applied to other embodiments without the use of the inventive faculty. For example, digital signatures, encryption (e.g., DES, RSA, and others), and other coding techniques can be incorporated with the present invention. Thus, the present invention is not intended to be limited to the embodiments shown herein but is to be accorded the widest scope consistent with the principles and novel features disclosed herein.

What is claimed is:

1. A method for providing a postage indicium, comprising:

receiving at a secure processing unit a user request from a local computer to print a postage indicium, the request including a first data file retrieved from a storage unit provided in the local computer, the first data file including accounting information; and transmitting a print command message from the secure processing unit to the local computer, the print command message having been processed to allow for authentication, wherein the postage indicium is generated at a device configured to generate the postage indicium according to the print command message.

2. The method of claim 1, further comprising:

directing a printer to print the postage indicium in response to the print command message, the printer being the device configured to generate the postage indicium.

3. The method of claim 1, wherein the second data file includes accounting information that has been updated to account for the printed postage indicium, the method further comprising:

storing the second data file to the storage unit.

4. The method of claim 1, wherein the first data file is encrypted with a particular encryption standard.

5. The method of claim 1, wherein the first data file is encrypted with a DES algorithm or a RSA algorithm.

6. The method of claim 1, wherein the print command message is signed with a particular digital signature algorithm.

7. The method of claim 1, wherein the print command message is signed with a digital signature standard (DSS) algorithm or an elliptical curve algorithm.

8. The method of claim 1, wherein the accounting data includes a descending register value indicative of an amount of available funds.

9. The method of claim 1, wherein the accounting data includes an ascending register value indicative of an amount of funds previously used.

10. The method of claim 1, wherein the accounting data includes a control total register value indicative of an amount of available funds plus an amount of funds previously used.

11. The method of claim 1, wherein the storage unit is open and user accessible.

12. The method of claim 1, wherein the storage unit is a hard disk drive.

13. A method for printing postage indicia comprising:

receiving at a secure processing unit a user request from a first computer to print a postage indicium and a first data file retrieved from a storage unit, the first data file including accounting information;

determining whether sufficient funds exist to cover the postage indicium; and transmitting a print command message from the secure processing unit to a second computer, the print command message having been processed to allow for authentication, wherein the postage indicium is printed using the print command message at a device configured to print the postage indicium, the device being coupled to the second computer.

14. The method of claim 13, wherein if sufficient funds exist, the method further comprising:

updating the first data file to a second data file to account for the postage indicium;

generating a print command message authorizing printing of the postage indicium, the print command message having been processed to allow for authentication;

sending the print command message to a local computer, and securing the second data file, wherein the first computer and the second computer are the same.

15. The method of claim 14, wherein the data file is encrypted with a particular encryption standard.

16. The method of claim 14, wherein the securing step includes re-encrypting the updated data file with the particular encrypting standard.

17. The method of claim 14, further comprising:

performing an error check prior to the generating step.

18. A postage metering system having a local computer and a printing component including a user interface configured to receive a user request and a storage unit configured to store a data file, the data file being secure and including accounting data, the system comprising:

a secure processing unit coupled to the local computer and including:

a memory configured to store the data file, a processing unit coupled to the memory and configured to receive the data file and the user request, process the user request, generate a first message responsive to the user request, the message having been processed to allow for authentication, update the data file to account for the processed user request, secure the updated data file, and send the secure data file to the local computer, wherein the data file is encrypted with a particular encryption standard, and wherein the local computer initiates printing of a postage indicium at the printing component according to the secured data file received by the local computer.

19. The system of claim 18, wherein the storage unit is open and user accessible.

20. The system of claim 18, wherein the user request is for a postage printing operation, the processing unit being further configured to update the data file to account for a postage indicium authorized for printing.

21. The system of claim 18, wherein the user request is for a funding operation, the processing unit being further configured to receive an authorization message in response to the first message, and update the data file to account for additional funds authorized in the authorization message.

22. A postage system, comprising:

means for receiving at a secure processing unit a user request from a local computer to print a postage indicium, the request including a first data file retrieved from a storage unit provided in the local computer, the first data file including accounting information; and means for transmitting a print command message from the secure processing unit to the local computer, the print command message having been processed to allow for authentication; and means for printing the postage indicium according to the print command message.

23. A computer readable medium including a computer program for use in generating a postage indicium, the computer program comprising:

code for receiving at a secure processing unit a user request from a local computer to print a postage indicium, the request including a first data file retrieved from a storage unit provided in the local computer, the first data file including accounting information; and code for transmitting a print command message from the secure processing unit to the local computer, the print command message having been processed to allow for authentication, code for printing the postage indicium at a printer coupled to the local computer according to the print command message.

* * * * *

UNITED STATES PATENT AND TRADEMARK OFFICE

CERTIFICATE OF CORRECTION

PATENT NO. : 6,816,844 B2
DATED : November 9, 2004
INVENTOR(S) : JP Leon

It is certified that error appears in the above-identified patent and that said Letters Patent is hereby corrected as shown below:

Column 13, line 13 - Column 14, line 13,
Replace claim 23 and insert the following:
23. A computer readable medium including a computer program for use in generating a postage indicium, the computer program configured to control operations of a computer, the computer program comprising:

code to operate the computer to receive at a secure processing unit a user request from a local computer to print a postage indicium, the request including a first data retrieved from a storage unit provided in the local computer, the first data file including accounting information; and code to operate the computer to trasmit a print command message from the secure processing unit to the local computer, the print command message having been processed to allow for authentication, code to operate the computer to print the postage indicium at a printer coupled to the local computer according to the print command message.

Signed and Sealed this

Twenty-eighth Day of June, 2005

JON W. DUDAS
*Director of the United States Patent and Trademark Office*